United States Patent [19]

Gullett

[11] Patent Number: 5,062,481

[45] Date of Patent: Nov. 5, 1991

[54] CONTROL OF 'U' TUBING IN THE FLOW OF CEMENT IN OIL WELL CASINGS

[75] Inventor: Paul D. M. Gullett, Grantham, United Kingdom

[73] Assignee: Sterling Design International, Newark, United Kingdom

[21] Appl. No.: 592,450

[22] Filed: Oct. 3, 1990

[30] Foreign Application Priority Data

Oct. 3, 1989 [GB] United Kingdom ..... 8922302

[51] Int. Cl.[5] ..... E21B 17/14; E21B 33/16

[52] U.S. Cl. ..... 166/153; 166/155; 166/242; 166/188

[58] Field of Search ..... 166/153, 154, 155, 156, 166/157, 188, 242, 325, 326, 327

[56] References Cited

U.S. PATENT DOCUMENTS

| | | | |
|---|---|---|---|
| 3,543,852 | 12/1970 | Taylor | 166/155 |
| 3,638,730 | 2/1972 | Smith | 166/291 |
| 4,836,279 | 6/1989 | Freeman | 166/153 |

FOREIGN PATENT DOCUMENTS

| | | | |
|---|---|---|---|
| 1116169 | 11/1961 | Fed. Rep. of Germany | 166/326 |
| 890144 | 5/1959 | United Kingdom . | |
| 2036131 | 10/1979 | United Kingdom . | |
| 2147641 | 10/1984 | United Kingdom . | |
| 2172031 | 3/1985 | United Kingdom . | |
| 2223782 | 9/1989 | United Kingdom . | |

*Primary Examiner*—William P. Neuder

[57] ABSTRACT

A device for controlling "U" tubing in the flow of a fluid such as cement in oil well casings comprises a body which is inserted in the casing towards its lower end. The body provides a passage so that cement can pass through the body and out of the end of the casing before passing up round the exterior of the casing, displacing mud in front of it. A member is mounted in the passage which normally does not impede the flow of cement through the passage. However, when the pressure differential at spaced points along the flow of cement increases beyond the predetermined level as a result of 'U' tubing, the member moves to restrict severely the area of the passage. This halts 'U' tubing. The member can move back to the full flow position once 'U' tubing has been controlled.

20 Claims, 17 Drawing Sheets

CONTROL OF 'U' TUBING IN THE FLOW OF CEMENT IN OIL WELL CASINGS

BACKGROUND OF THE INVENTION

The invention relates to the control of 'U' tubing in the flow of cement or other fluids in oil well casings.

As an oil well is drilled, casings of successively decreasing diameters are inserted into the drilled hole, with the final casing, the production casing, conveying the oil from the well to the well head. The succession of casings are cemented in position to, for example, prevent drilling fluid from circulating outside the casing and causing erosion. Cementing is also necessary in the casings close to the surface to seal off and protect fresh water formations, provide a mounting for blow-out preventer equipment and for supporting the inner casings.

Cementing is achieved by preparing a cement slurry and then pumping it down the casing. As it is pumped down, the cement slurry displaces the mud already in the casing and passes out of the end of the casing and then up the exterior of the casing, displacing the mud in front of it. When all the mud has been displaced and the cement slurry is therefore continuous around the outside of the casing, pumping stops and the cement is allowed to set. The end of the casing includes a one-way value which, when cementing is complete, prevents the cement passing back up the casing.

The cement slurry has a density which is greater than the density of the mud which it displaces. This can result in the phenomenon of 'U' tubing in which the forces resisting the flow of cement are insufficient to allow the pumping pressure to be maintained and the cement slurry falls in the casing under the effect of gravity faster than the pumping rate. Accordingly, when 'U' tubing occurs, the cement slurry is no longer under the control of the pump.

This is undesirable because the increased flow rates in 'U' tubing can cause a strongly turbulent flow which can erode seriously any weak formations around the casing and cause laminar flow an undesirable flow regime while equilibrum is being sought. Further, it can result in a vacuum being formed behind the 'U' tubing cement slurry and the slurry may then halt while the pump slurry fills the vacuum. It can also cause surging in the rate at which the mud is forced to the surface and this can be difficult to control at surface without causing unfavourable pressure increases downhole.

SUMMARY OF THE INVENTION

According to the invention, there is provided a device for preventing 'U' tubing in the flow of fluid in oil well casings comprising a body for sealing engagement with an interior of a casing string towards an end thereof and having opposed end walls, a passage extending between said end walls for passing fluid under pressure from a supply thereof to the end of the casing, a member being arranged in said passage to move from a first position in which fluid flow through said passage is permitted and a second position in which said flow is reduced when the pressure in the flow of the cement exceeds a predetermined value likely to cause the commencement of 'U' tubing, said member returning to said first position when said pressure reduces below the said predetermined value.

Thus, by sensing departures from the pressure of controlled flow of the fluid, such as cement, and partially closing the passage through the device as soon as that pressure differential is exceeded, 'U' tubing is prevented. Once the pressure differential returns to a normal value, the passage is opened again and the original flow of fluid continues.

The following is a more detailed description of some embodiments of the invention, by way of example, reference being made to the accompanying drawings in which:

DESCRIPTION OF THE PREFERRED EMBODIMENTS

Figure 1:
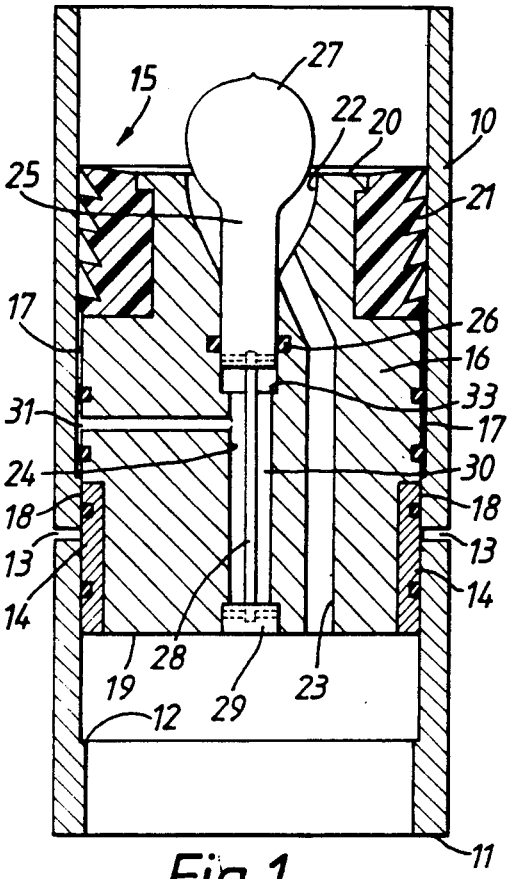
FIG. 1 is a schematic section of a sliding sleeve of a casing string of an oil well containing a first embodiment of 'U' tubing control device, the device being shown prior to final positioning.
Figure 2:
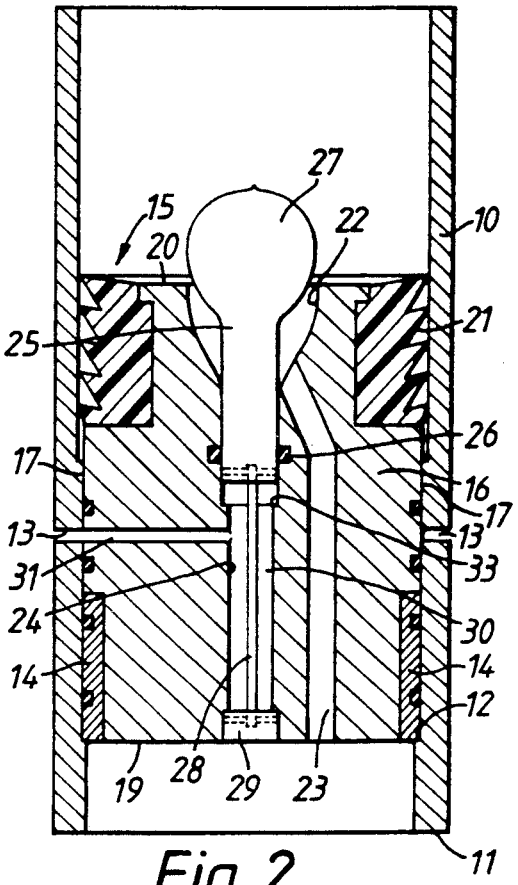
FIG. 2 is a view similar to FIG. 1, but showing the device in its final position in the sleeve and open for the flow of cement.
Figure 3:
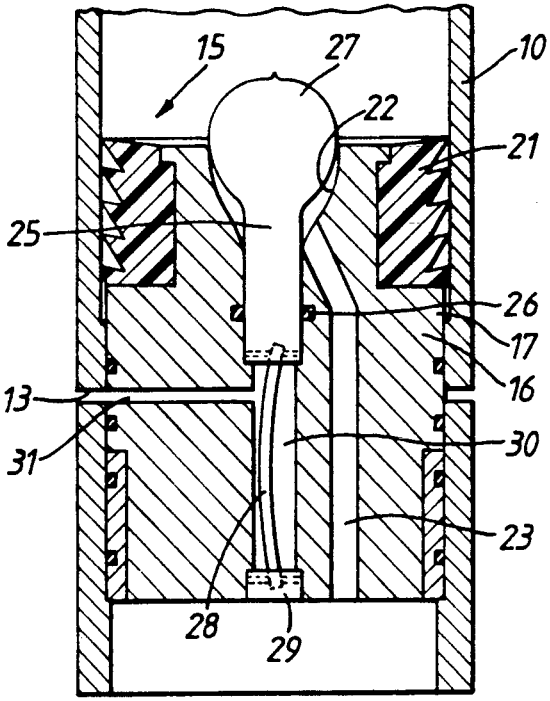
FIG. 3 is a view similar to FIGS. 1 and 2 but showing the device providing a reduced flow at area.

Referring first to FIGS. 1 to 3, an oil well includes a casing string having a sliding sleeve 10 of metal which has been positioned in a well and which is ready for cementing. The sliding sleeve 10 has an open end 11 and, adjacent this end, is provided with an interior annular rebate 12 (see FIG. 1). A pair of diametrically opposed holes 13 are provided in the casing, adjacent the end 11, and, in the position shown in FIG. 1, are closed by a sleeve 14 held in position by frictional engagement with the interior of the sleeve 10.

The first form of 'U' tubing control device 15 is inserted in the casing and comprises a body 16 having a generally cylindrical exterior surface 17 of slightly smaller diameter than the diameter of the interior of the sleeve 10. An annular recess 18 is provided in the surface 17 around the leading end 19 of the body 16 for picking-up the sleeve 14. At the trailing end 20, an annular elastomeric finned seal 21 is provided, with the fins engaging the interior wall of the casing 19 to provide a fluid tight seal therebetween.

The trailing end 20 is also provided with a cup shaped inlet 22. Two passages lead from the inlet—the first passage 23 extends to the leading end 19 of the body 16. The second passage 24 contains an end of a piston 25. A seal 26 is provided between the piston and the second passage 24 to prevent the passage of cement into the second passage.

The piston 25 has an enlarged head 27 which, in the position of the piston 24 shown in FIG. 1, is clear of the cup 22 to provide an unobstructed passage for cement into the cup 22 and through the first passage 23. The end of the piston 25 opposite the head 27 is connected to one end of a strut 28 whose other end is fixed in a block 29 that closes the second passage 24. Thus, a chamber 30 is formed beneath the inner end of the piston. An inlet 31 leads from the chamber to the exterior surface 17 of the body 16, for a purpose to be described below.

The 'U' tubing device described above with reference to FIGS. 1 and 2 is used in the following way.

When cementing is to take place a cement slurry is mixed at the well head. A cementing head is fixed to the casing, with the 'U' tubing device 15 in the casing at the well head. The device 15 is moved down the casing either by the cement slurry as it is pumped or by a spacer fluid introduced above the drilling mud and prior to the cement slurry. The device 15 slides down the interior of the casing until the resess 18 engages the sleeve 14, when continued movement of the device 15 causes the sleeve 14 to move with the device and so uncover the holes 13. The device 15 continues to move until the leading end 19 engages the annular rebate 12. This position is shown in FIG. 2.

The cement slurry is then pumped into the casing and passes round the head 27 and into the cup shaped inlet 22, before passing through the first passage 23, out of the leading end 19 of the plug, out of the open end 11 of the sleeve 10 through the end of the casing string and then passes up round the exterior of the casing string, displacing the mud in front of it. Cement from the exterior of the casing passes through the hole 13 and the inlet 31 into the chamber 30, so that the end 32 of the piston 25 is subject to the pressure in the cement slurry at a point on the exterior of the casing spaced from the end of the casing. The head 27 is subject to the pressure of the cement slurry at the cup-shaped inlet 22.

While the flow of the cement slurry is under the control of the wall head pump, the pressure differential across the piston 25 is insufficient to move the piston and so flow continues. If, however, cement starts to move more quickly than the pumping rate (a phenomena which will cause U-tubing it unchecked), it is accompanied by a sudden pressure increase which, when it reaches the cup-shaped inlet 22, increases substantially the pressure differential across the piston 25. At this point, the pressure in the cement downstream of the device 15, particularly in the annulus around the exterior of the sleeve 10, remains at its existing value, so creating a monontary pressure differential between the two points in the cement flow.

The strut 28 is designed so that, when such a pressure differential occurs, it deflects, causing the piston 25 to slide within the second passage 24 so causing the head 27 to enter the cup-shaped inlet 22. Movement of the piston is limited by a shoulder 33 within the second passage 24.

This position is shown in FIG. 3.

This restriction of the passage for cement flow prevents acceleration of the cement slurry. The restriction continues for as long as the increased pressure differential exists. Once the pressure differential is reduced, the strut 28 straightens and moves the head 27 out of the cup-shaped inlet 22 to allow normal flow to continue. If, however, a pressure increase likely to cause 'U' tubing commences again, the strut will deflect and this will happen as many times as this pressure increase occurs.

The device 15 is made of a material which can be readily drilled out of the casing, so that once cementing is completed, the device 15 can be removed to allow passage of the drill string and further casings.

Referring next to FIGS. 4 to 9, the second form of 'U' tubing control device will be described. Parts common to FIGS. 4 to 9 on the one hand and FIGS. 1 to 3 on the other hand will be given the same reference numerals and will not be described in detail.

Figure 4:
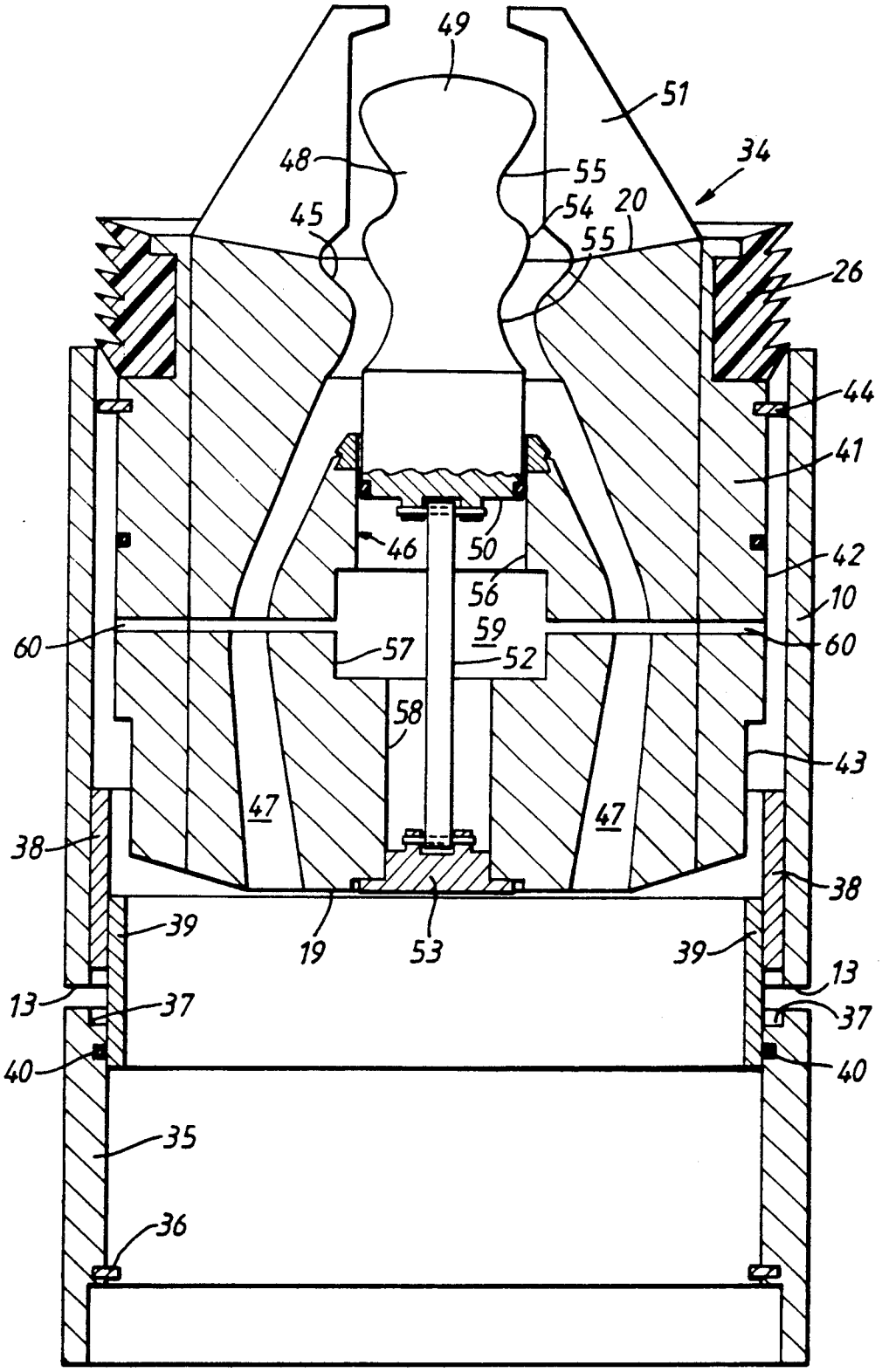
FIG. 4 is a schematic cross sectional view of a second form of sliding sleeve containing a second embodiment of device for controlling 'U' tubing, the device being shown in a position prior to its final position.

Referring first to FIG. 4, the sleeve 10, prior to positioning of the second form of device 34, is provided adjacent its end with an annular portion 35 of decreased diameter. Adjacent the open end 11 of the sleeve 10, this portion 35 is provided with an inwardly projecting shear pins 36 for a purpose to be described below. At its opposite end, the annular portion 35 provides a rebate 37 adjacent the holes 13.

Two sleeves 38,39 are provided in the sliding sleeve 10. The first sleeve, prior to insertion of the device 34, engages the casing frictionally, above the holes 13. The second sleeve 39 is in frictional engagement with the inner surface of the annular portion 35 and the inner surface of the first sleeve 38, and so covers the holes 13. A seal 40 is provided on the annular portion 35 to engage with the second sleeve 39 to prevent the passage of fluid therebetween.

The device 34 has a body 41 whose exterior diameter is substantially the interior diameter of the first sleeve 38. Thus, prior to positioning of the device 34 in the casing, there is an annular space between the exterior surface 42 of the body 41 and the interior of the sleeve 10.

An annular recess 43 is provided around the leading end 20 of the second body 41 with a diameter substantially equal to the interior diameter of the second sleeve 39.

The trailing end 20 of the body 41 carries a seal 26 corresponding to that described above with reference to FIGS. 1 to 3. On the exterior surface 42 of the second body 41, adjacent this seal 26, is a detent ring 44.

The body 41 has an inlet 45 which is coaxial with the axis of the body 41 and which, along its length, starting from the trailing end 20, increases in diameter and then decreases in diameter.

A bore 46 extends from an inner end of the inlet 45 through the body 41, coaxial with the axis of the body. A plurality of passages 47 also extend from the inner end of the inlet, pass around the bore 46 and emerge at the leading end 19.

A piston 48 is mounted in the body with a head 49 at one end and a flat end surface at the other end. The head 49 is protected and restrained from upward movement by a plurality of fingers 51 spaced angularly around the inlet 45. The end surface 50 of the piston 48 is connected to one end of an oval ring 52, whose opposite end is connected to a mounting 53 which closes the bore 46 at the leading end 19 of the body 41.

The exterior surface of the piston decreases in diameter from the head 49, then increases in diameter, decreases in diameter and finally increases in diameter again. Thus, between the head 49 and the end surface 50, the piston is provided with an annular projection 54 and two annular depressions 55 which are complementary in shape to the shape of the inlet 45, in the position of the piston shown in FIG. 4.

The bore 46 has an initial portion 56 of constant diameter followed by a portion of increased diameter 57 and a final portion 58 of a reduced diameter less than the diameter of the initial portion 56. The portion of the piston 48 adjacent the end surface 50 is a tight sliding fit in the initial portion, so forming, between the end surface 50 of the piston 48 and the mounting 53, a chamber 59. Two inlets 60 lead radially from this chamber to diametrically opposite points on the exterior surface 42 of the body 41, for a purpose to be described below.

The second device is used in the following way.

Figure 5:
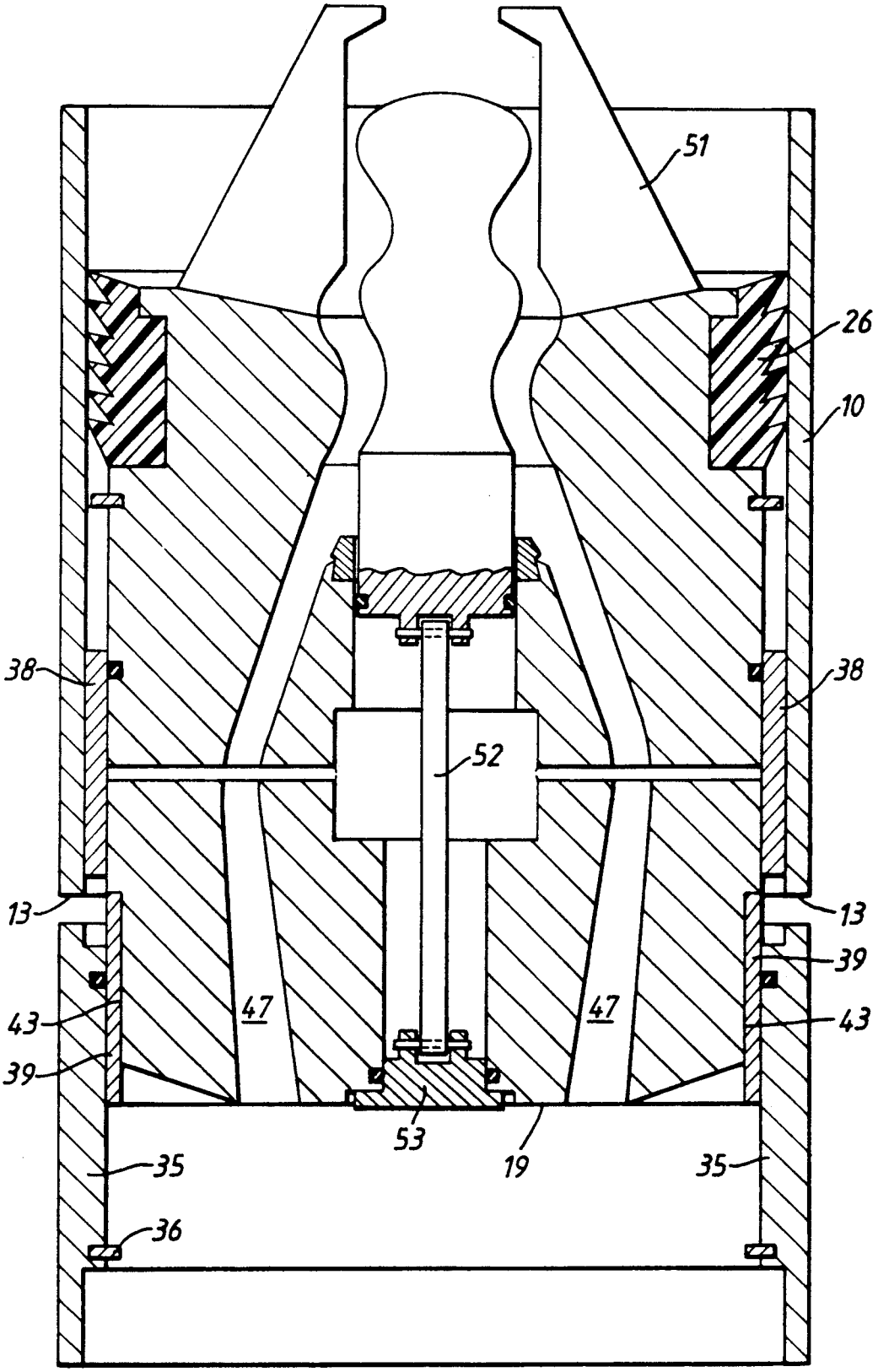
FIG. 5 is a similar view to FIG. 4, but showing the device of FIG. 4 in a more advanced position prior to its final position.
Figure 6:
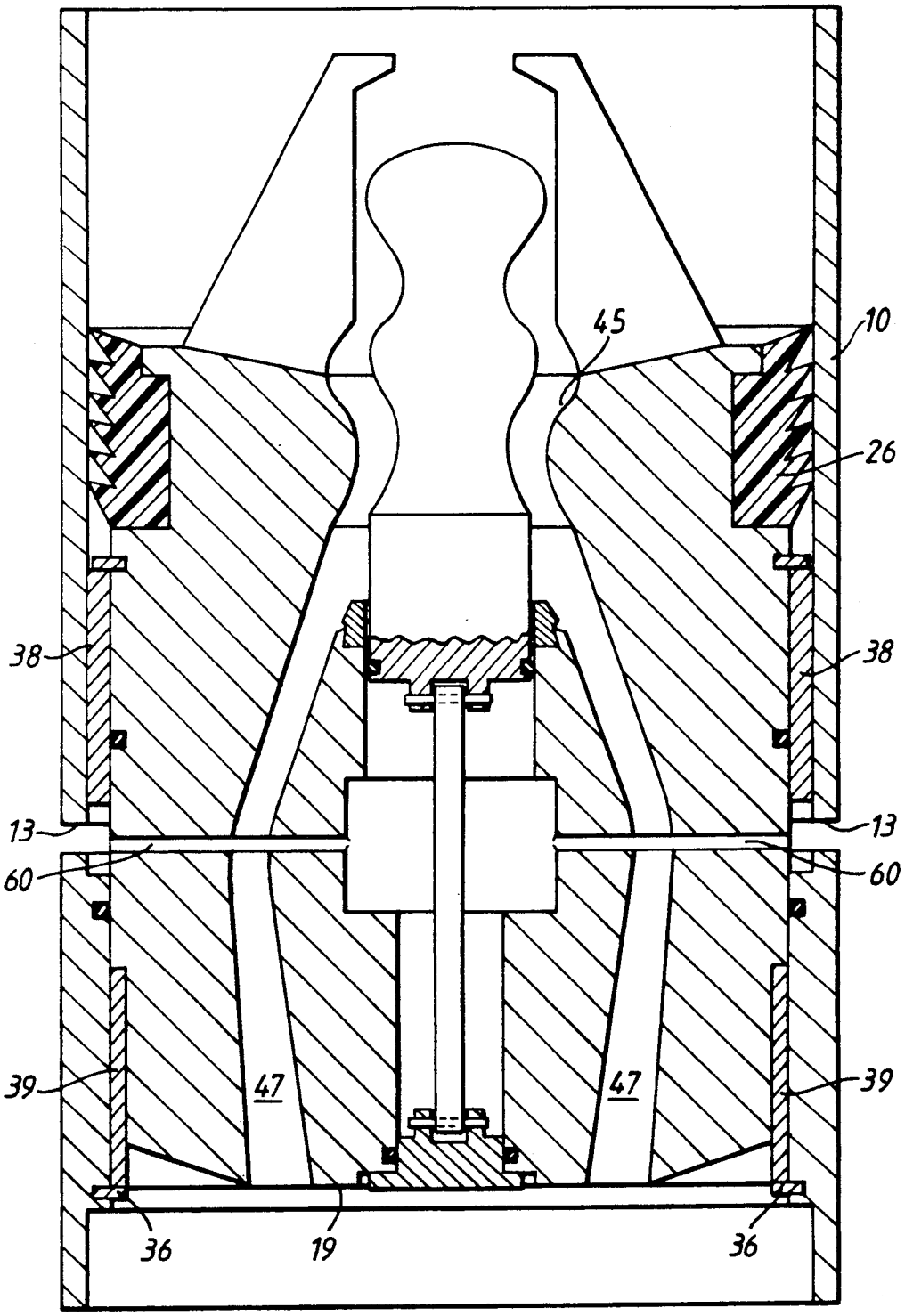
FIG. 6 shows the device of FIGS. 4 and 5 in its final position and providing a passage of maximum area for the flow of cement.

The device 34 is introduced into the sleeve 10 in the manner described above with reference to FIGS. 1 to 3. Its position as it approaches the end of the casing is shown in FIG. 4. After reaching this position, the rebate 37 engages with the second sleeve 39, sliding the sleeve over the annular portion 35 and so uncovering the holes 13. This is shown in FIG. 5. This movement continues until the second sleeve engages the annular ring 36, at which point the detent ring 44 also engages, but does not move, the first sleeve 38. In this position, the holes 13 are aligned with the inlets 60. This position is shown in FIG. 6.

In this position, the cement slurry flows easily between the piston 48 and the inlet 45, passing through the passages 47 to emerge at the leading end 19 and then progress up round the exterior of the casing 10. Cement also passes through the holes 13 and the inlets 60 to the chamber 59. This disposition is maintained while the cement slurry is under the control of the pumps.

Figure 7:
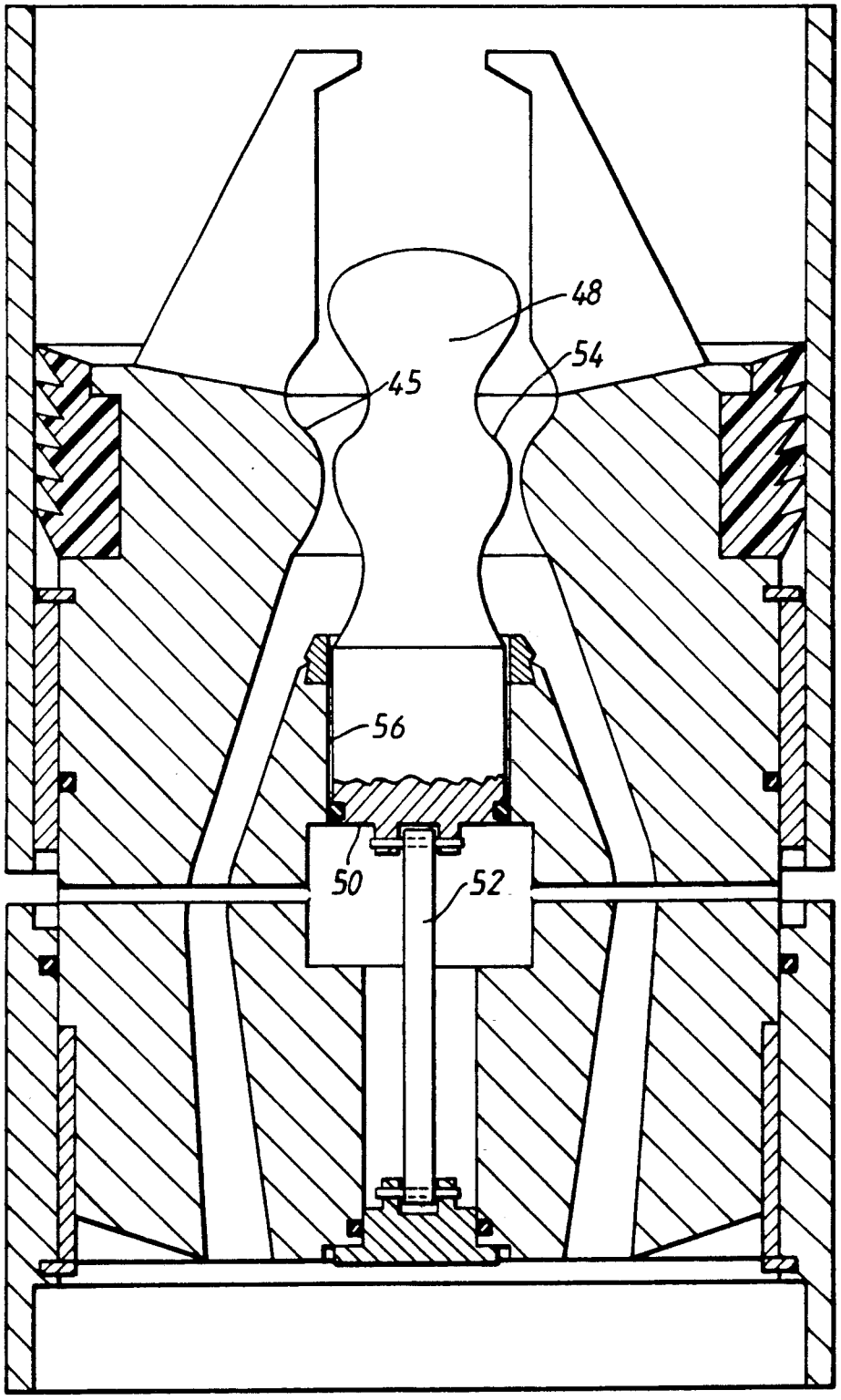
FIG. 7 is a similar view to FIG. 6, but showing the device providing a reduced flow area.

Referring next to FIG. 7, when a pressure increase occurs likely to result in 'U' tubing, a pressure differential is created across the piston 48, the oval ring 52 deflects and causes the piston 48 to slide into the initial portion 56 of the bore 46. This moves the shaped exterior surface of the piston 48 out of register with the shaped inlet 45 so that the annular projection 54 on the piston is in register with the minimum diameter portion of the inlet 45.

In this position, the flow of cement slurry is severely reduced, so preventing 'U' tubing occurring. The piston maintains this position until pressure differential decreases, when it reassumes the position shown in FIG. 6 to allow full flow of cement. This is repeated as many times as a pressure increase.

It is possible that the device, when in the restricted flow position of FIG. 7, may become blocked, perhaps by particles of cement being trapped in the narrow passage between the inlet 45 and the annular projection 54 on the piston 48. If this occurs, there will be a further increase in pressure as the pump slurry builds up behind the device.

Figure 8:
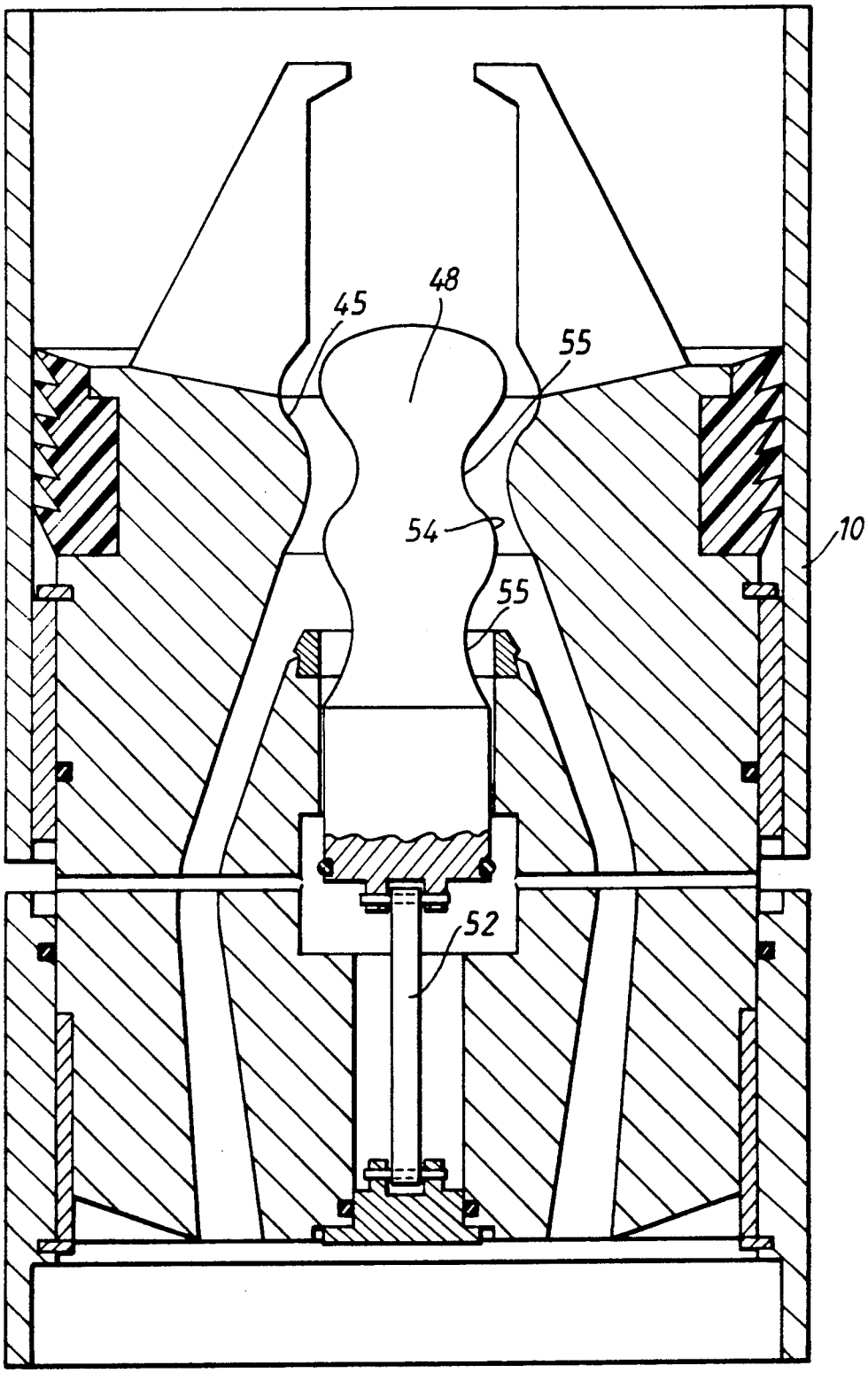
FIG. 8 is a similar view to FIGS. 6 and 7, but showing the device in a further position providing a self-cleaning feature.

In this circumstance, the ring 52 will deflect further, to the position shown in FIG. 8 where the shapes of the inlet 45 and the piston 48 are once again in register to provide a maximum flow area. This allows the device to clear itself under these circumstances.

Once the cement slurry has filled completely the space around the exterior of the casing, a solid plug 62 is fed from the cementing head down the casing string.

Figure 9:
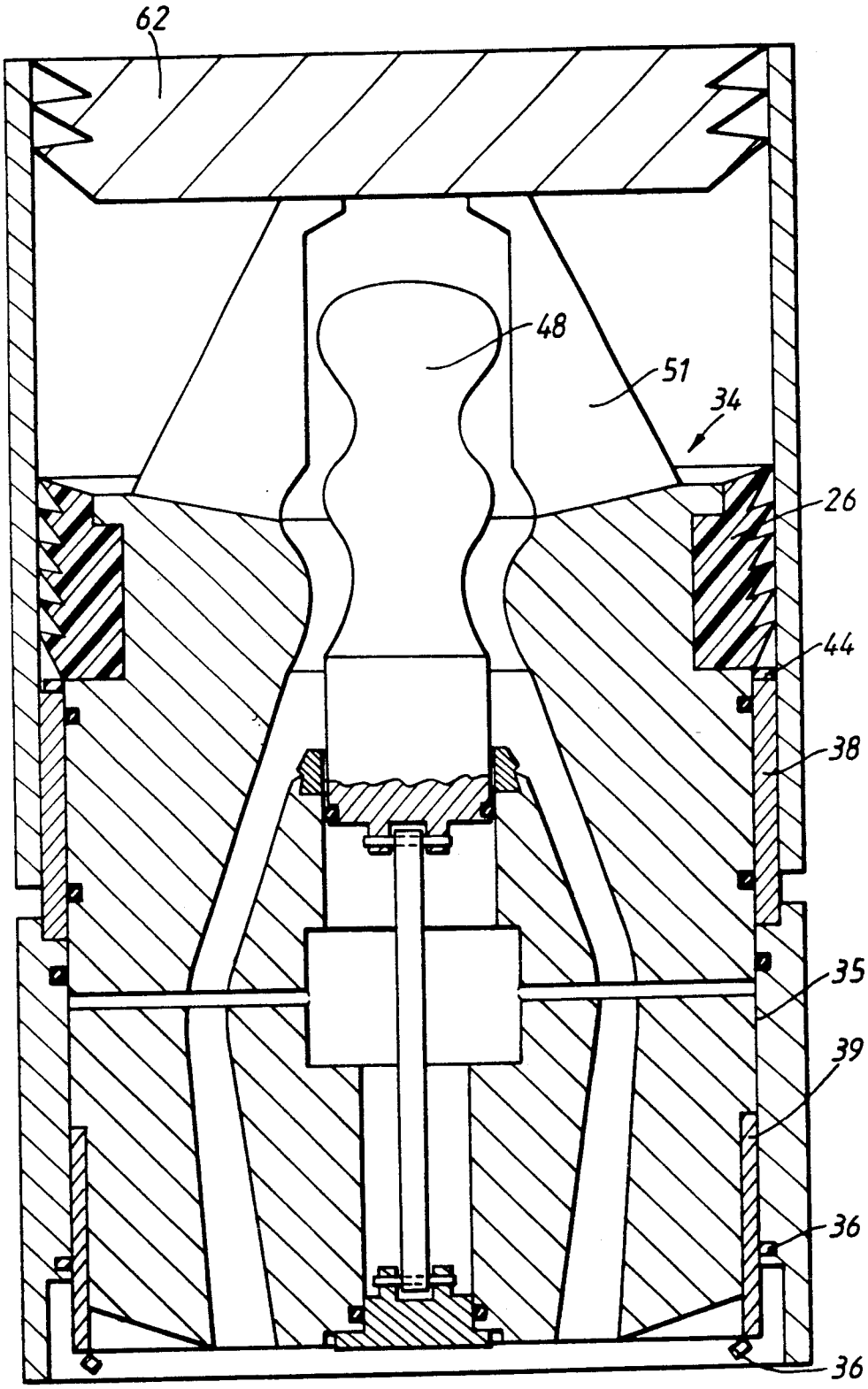
FIG. 9 is a similar view to FIGS. 6, 7 and 8, but showing a plug closing the device and pushing the device out of the end of the sleeve.

This plug 62, see FIG. 9, engages the fingers 51. Pumping is continued, and the pressure generated on the plug 62 causes the second sleeve 39 to shear the pins 36 and the first sleeve 38 to shear the detent ring 44. This allows the device 34 to be forced out of the end of the casing string, where it no longer interferes with subsequent drilling operations.

Figures 10A, 10B, 10C:
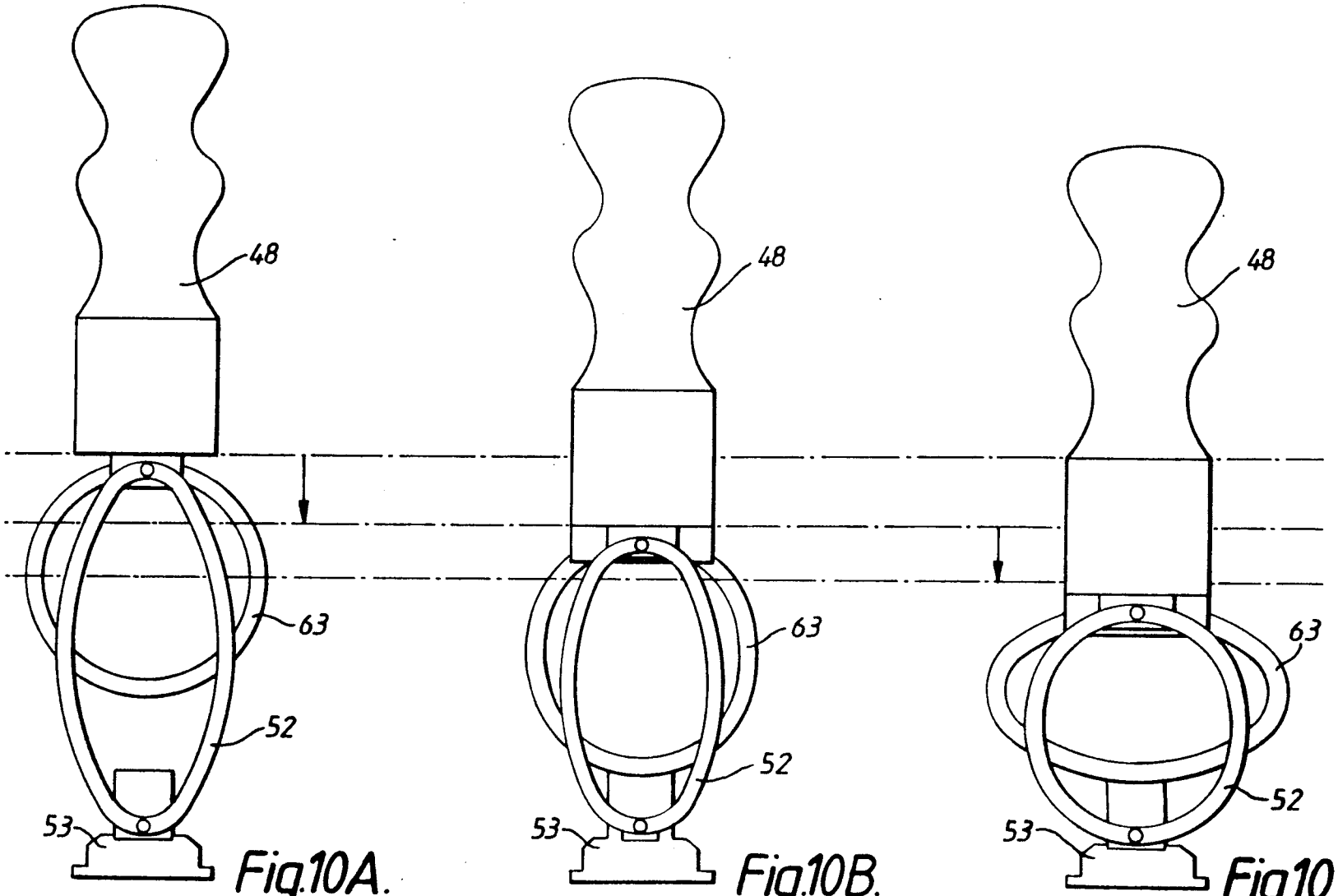
FIGS. 10A, 10B and 10C show an alternative arrangement of structural members between a piston and a body of the device of FIGS. 4 to 9, the piston being shown in a first, a second and a further position.

Referring now to FIGS. 10A, 10B and 10C, it will be seen that an additional, circular, ring 63 may be provided in addition to the ring 52. In this case, the diameter of the ring 52 between the end surface 50 of the piston 48 and the mounting 53 will be greater than the diameter of the additional ring 63. The arrangement is such that the additional ring 63 does not engage the mounting 53 until the piston 48 is in its second position. Thus, the pressure difference necessary to control the movement of the piston 48 to the further position is controlled by the two rings 52 and 63 together and thus allows the further position to be reached only when the pressure differential is substantially greater than the pressure differential necessary to move the piston 48 between the first and second positions. This further position may be the self cleaning position described above with reference to FIGS. 4 to 9.

Figure 11:
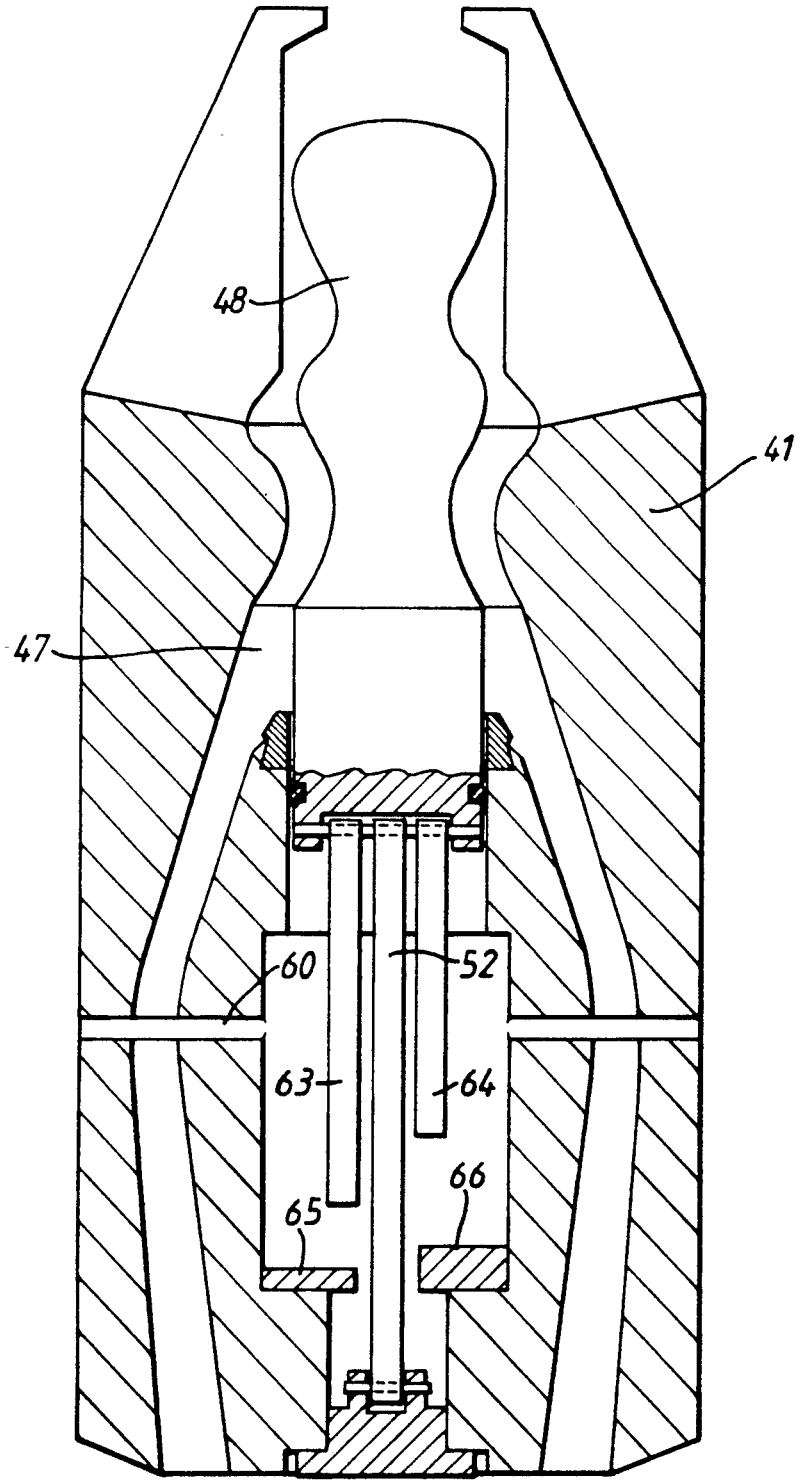
FIG. 11 is a similar view to FIGS. 4 to 9 but showing an alternative arrangement of structural members between the piston and the body providing first, second and two further positions of a piston of the device.

Referring next to FIG. 11, it will be appreciated that three rings 52, 63, 64 may be provided for fine tuning of the load resistance. In this case, the bore 46 is stepped to provide abutments 65,66 which engage the additional rings 63, 64 at respective different points in the movement of the piston 48. The height of the abutments may be varied to control the point in the movement of the piston at which the rings become operative.

Figure 12:
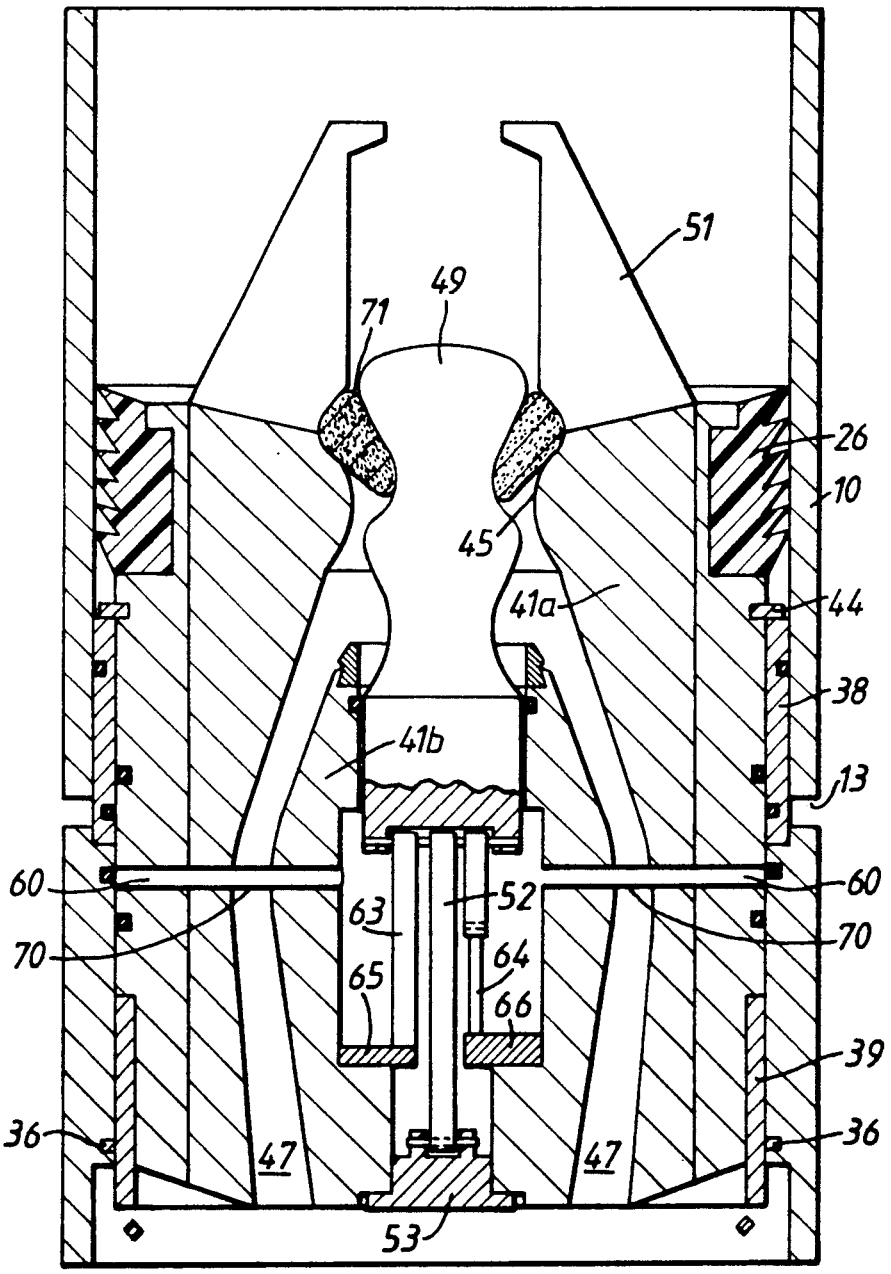
FIG. 12 is a cross sectional view of a further form of the device in a plugged condition and having structural member in accordance with the embodiment of FIG. 11.
Figure 13:
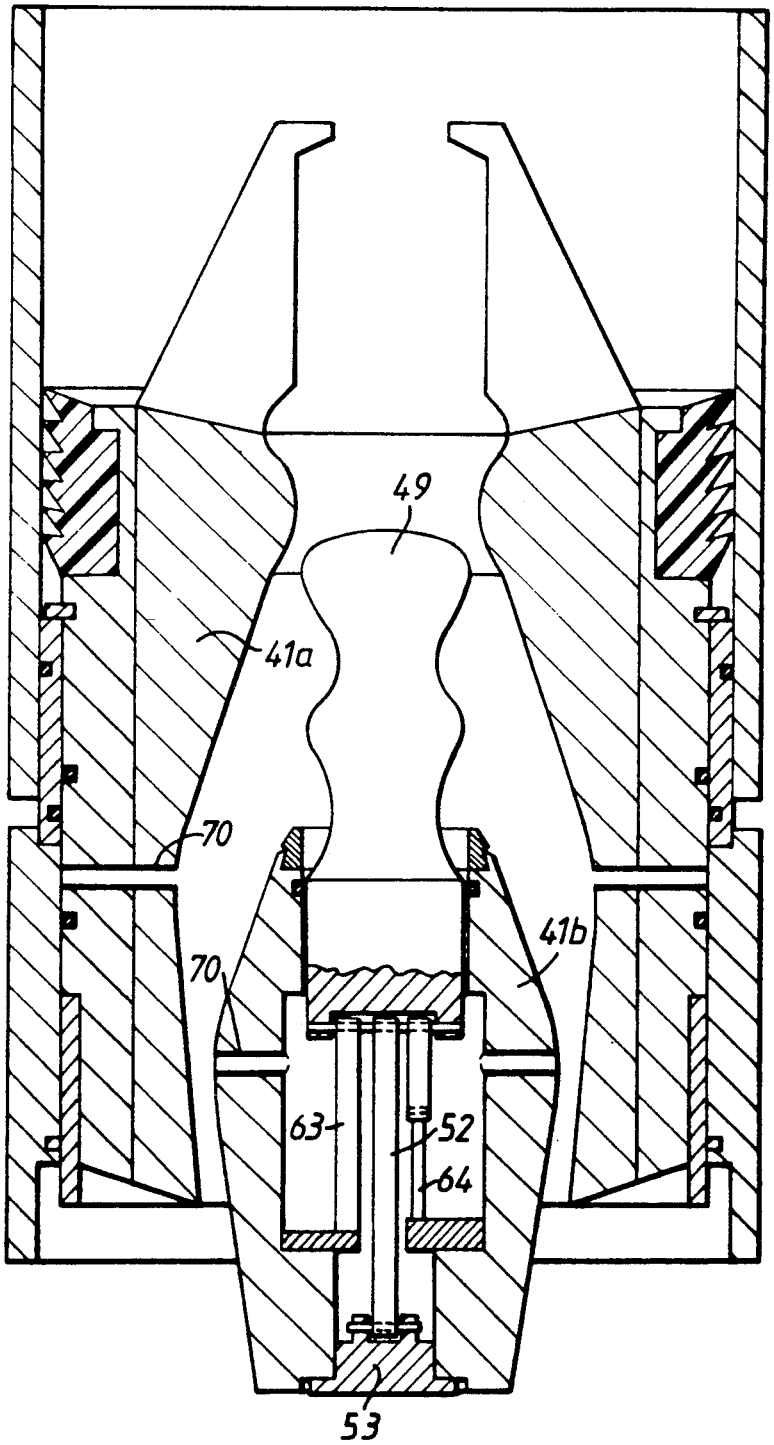
FIG. 13 is a similar view to FIG. 12, but showing a core of the device of that Figure pushed out of a body of the device

Referring next to FIGS. 12 and 13, the further form of the device is similar to the embodiment of FIGS. 4 to 9 and parts common to the device of FIGS. 12 and 13 and to the embodiment of FIGS. 4 to 9 will be given the same reference numerals and will not be described in detail.

In the device of FIGS. 12 and 13 has a single passage 47 separating the body 41 into an outer shell 41*a* and an inner core 41*b*. The inlets 60 are formed by tubes 70 which extend through the sheet 41*a* and the core 41*b* and so, in the position of the device shown in FIG. 12, the core 41*b* is held in position by the tubes 70.

The piston 49 is provided with three rings 53,63,64 as described above with reference to FIG. 11. The device of FIGS. 12 and 13 operates as described above with reference to FIGS. 4 to 11 to reduce the cement flow on sensing an increase in pressure likely to course U-tubing and will move to the self-cleaning position on continued build-up of pressure.

It is possible that the self-cleaning position will be inadequate to clear obstructions around the inlet 45. As seen in FIG. 12, the inlet 45 may become completely blocked by a cement plug 71. In this case, pressure will increase behind the device.

Where this occurs, the increased pressure will force the body 41 down the sleeve 10 causing the second sleeve 39 to shear the shear pins 36. At the same time the detent ring 44 will force the first sleeve 38 downwardly to cover the holes 13 so that the ends of the inlets 60 will be covered by the sleeve 10, so preventing communication between the interior and the exterior of the sleeve 10. This is shown in FIG. 12.

The tubes 70 are designed to shear at such increased pressure, and before the detent ring 44 shears, so that, as seen in FIG. 13, the core 41*b* with the piston 49 is pushed out of the sheet 41*a*. This provides a path of greater cross-sectional area what the area of the passages 47 and so allows the plug 71 to clear, providing a safety feature.

The third device 80, shown in FIGS. 14 to 17, is carried in a casing collar 81 for incorporation into a casing string of an oil well. The collar includes threaded ends 82 for connection to respective casing sections (not shown).

The device 18 comprises a body 83 carrying an upper guide 84 for a flow control piston 85 arranged within the body 83. A middle piston 86 and a bottom cap 87 are beneath the control piston 85. The detailed construction and arrangement of these parts is as follows.

The body 83 is formed from a castable composite material such as a plastics material which projects into annular grooves 88 in the interior surface of the collar 81 to lock the body 83 to the collar 81. A passage 89 extends axially through the body 83 and has an upper section 90 and a lower section 91.

Figure 14:
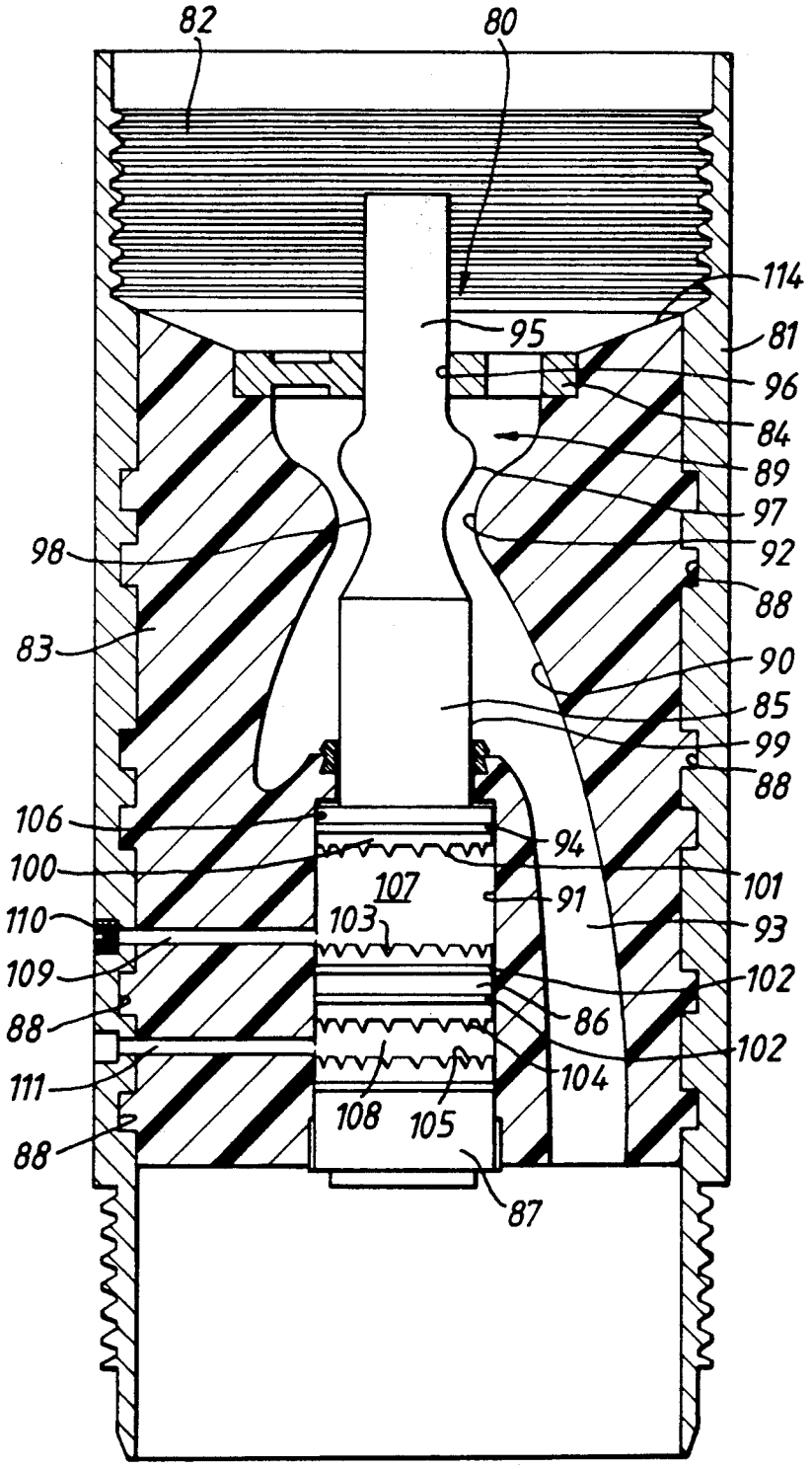
FIG. 14 is a schematic cross-sectional view of a third device for controlling 'U' tubing, the device being shown in a collar and in a position in which the flow of fluid past the device is permitted.
Figure 15:
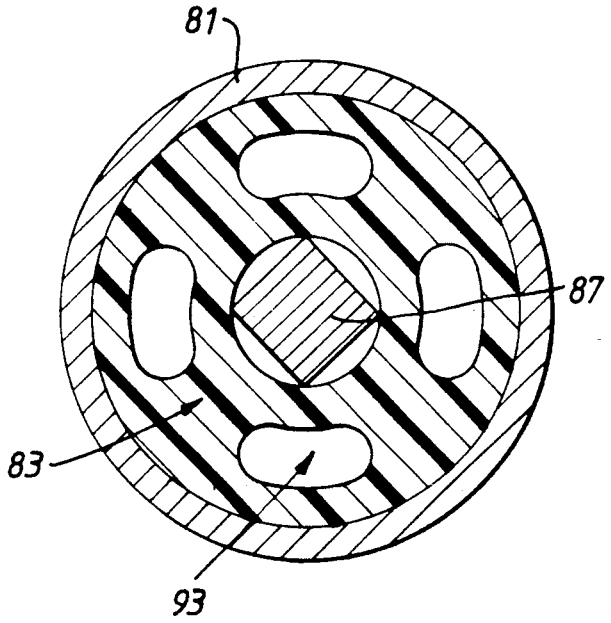
FIG. 15 is an underneath plan view of the device of FIG. 14.

The upper section 90 is widened at the upper end of the collar and narrows to a throat 92 before widening again towards the centre of the device 80. The lower part of the upper section 90 is connected to the lower end of the body 83 by four equiangularly spaced flow passages 93, one of which is shown in FIG. 14 and all of which can be seen in FIG. 15. These flow passages 93 extend through a portion of the body 83 between the outer surface of the body 83 and the lower section 91 of the passage 89.

The lower section 91 of the passage 89 is of generally right cylindrical shape and coaxial with the axis of the collar. It is provided with an inwardly directed step 94 towards its upper end (see FIG. 14), for a purpose to be described below.

The flow control piston 85 is generally cylindrical in shape and is largely received in the upper section 90 of the passage 89. A guide section 95 at the upper end of the piston 85 is received in a central aperture 96 of the upper guide 84 which is carried by the body 83 at the upper end of the body 83 (see FIG. 14).

Below the guide section 95, the piston 85 is provided with an annular bulge 97 followed by a waisted section 98 and a generally right cylindrical portion 99 that terminates in a cylindrical head 100 which, in the position of the piston 85 shown in FIG. 14 engages beneath the step 94. An O-ring 106 carried by the head 100 seals between the head 100 and the passage 89 to close the passage 89 at this point. Also in this position, the waist 98 in the piston 85 is aligned with the throat 92.

The lower surface of the head 100 is provided with projections 101 of pyramid shape (see FIG. 14).

The middle piston 86 is received in the lower section 91 for sliding movement and is provided with a pair of O-ring seals 102 on its outer surface for fluid tight engagement with the lower section 91 of the passage 89. An upper surface of the middle piston 86 is provided with recesses 103 shaped to receive the projections 101 on the flow control piston 85 and the lower surface of the middle piston 86 is provided with projections 104 of pyramid shape, for a purpose to be described below.

The middle piston 86 divides the lower section 91 of the passage 89 into upper and lower chambers 107,108.

The bottom cap 87 closes the lower end of the lower section 91 of the passage 89. It has an upper surface which is provided with recesses 105 shaped to receive the projections 104 on the middle piston 86.

A radially extending passage 109 extends from the exterior of the collar 81, through the body 83 and into the upper chamber 107. At its radially outer end, the passage 109 is provided with a one-way valve 110 for inward flow only.

Four radial passages 111 are also provided extending from the exterior surface of the collar 81 through the body 83 into the lower chamber 108. The function of these passages will be described below.

In use, the device 80 is prepared prior to insertion in a casing string. A source of nitrogen under pressure is connected to the passage 109 so that pressurised nitrogen passes into the upper chamber 107 via the valve 110. This forces the flow control piston 85 to its upper position shown in FIG. 14 and also forces the middle piston 86 into its lowermost position shown in FIG. 14. The force exerted on these parts is determined by the pressure of the nitrogen and this can be controlled as described below.

The collar 81 is then introduced into the casing string 115 (see FIGS. 16 and 17) prior to cementing, and lowered into a well. A cement slurry is mixed at the well head and then pumped into the casing.

The cement slurry passes the device 80 via the upper section 90 of the passage 89 and the flow passages 93. The upper section 90 is unobstructed by the flow control piston 85 and so the cement slurry passes freely. The cement then passes out of the open end of the casing string and up round the exterior of the casing string, displacing drilling mud in front of it.

The pressure in the upper chamber 107 is arranged such that, at the expected pumping pressure and cement slurry characteristics, the flow control piston 85 maintains the position shown in FIG. 14. However, compensation for any departure from these expected characteristics is provided by the passage of cement from the exterior of the casing through the passages 111 and into the lower chamber 108, so that the undersurface of the middle piston 86 is subject to the pressure in the cement slurry at a point on the exterior of the casing spaced from the end of the casing. This will move the middle piston 86 upwardly and further compress the nitrogen in the upper chamber 107. The degree of compression will depend on the instantaneous cement slurry pressure and so will provide a compensating force holding the flow control piston 85 in the position shown in FIG. 14, even if the pressure in the cement slurry departs from the pressure used in calculating the nitrogen pressure in the upper chamber 107.

If the cement starts to move more quickly than the pumping rate (a phenomena which will cause 'U' tubing if unchecked), it is accompanied by a sudden pressure increase which, when it reaches the device 80, increases substantially the pressure differential across the flow control piston 85. At this point, the pressure in the cement slurry downstream of the device 80, particularly in the annulus around the exterior of the collar 81, remains at its existing value, so creating a momentary pressure differential between these points in the cement flow.

When this happens, the flow control piston 85 will move downwardly, compressing the nitrogen in the upper chamber 107. This moves the bulge 97 in the flow control piston 85 towards a position in which it is in register with the throat 92.

This throttling of the passage for cement flow prevents acceleration of the cement slurry. The restriction continues for as long as the increased pressure differential exists. Once the pressure differential is reduced, the flow control piston 85 will move upwardly under the pressure of the nitrogen in the upper chamber 107 to move the bulge 97 away from the throat 92 to allow normal flow to continue. If, however, a pressure increase likely to cause 'U' tubing commences again, the cycle will be repeated.

If the device becomes blocked, perhaps by particles of cement being trapped in the narrow passage between the piston 85 and the upper passage section 90, there will be a further build-up of pressure as the pumped cement slurry builds up behind the device 80. This will move the bulge 97 past the throat 92 and into the wider lower part of the upper passage section 90. This increases the cross-sectional area of the passage 89 which will allow the flow of cement slurry to re-commence, so providing a self-cleaning feature.

The plastics material of the body 83 can be readily drilled out of the casing, so that once cementing is completed, the device 80 can be removed to allow passage of the drilling string and further casings. When this happens, the lower surface of the flow controlled piston 85 will engage the upper surface of the middle piston 86 and the lower surface of the middle piston 86 will engage the upper surface of the bottom cap 87. The projections 101 and 104 will engage in the associated recesses 103 and 105 to prevent these parts rotating during this drilling out.

Figure 16:
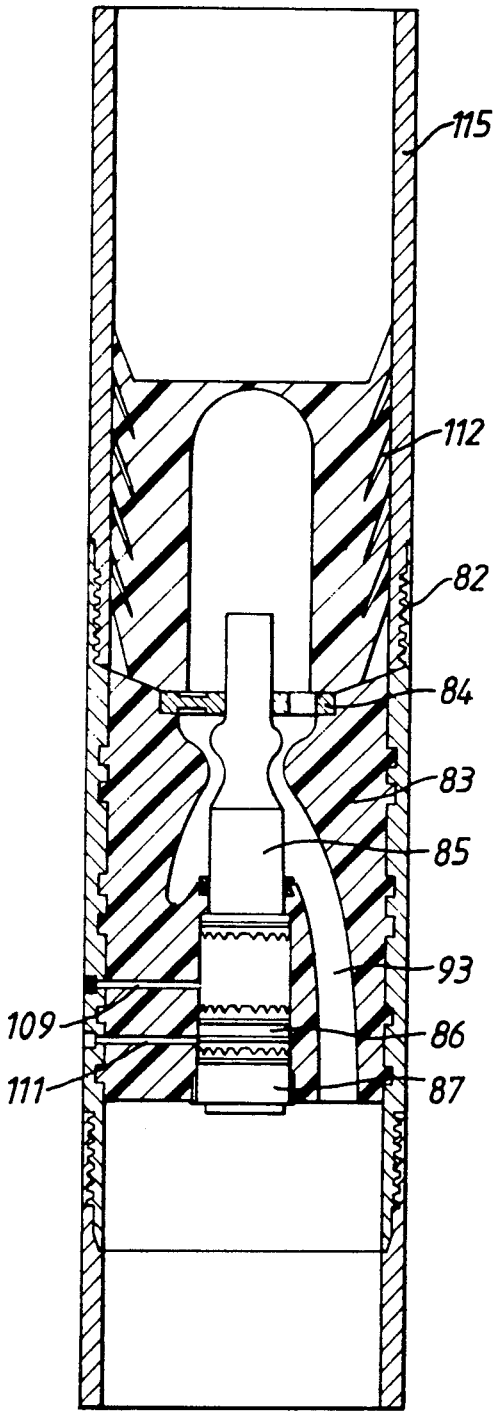
FIG. 16 is a similar view to FIG. 13 but showing the insertion of a bottom plug.
Figure 17:
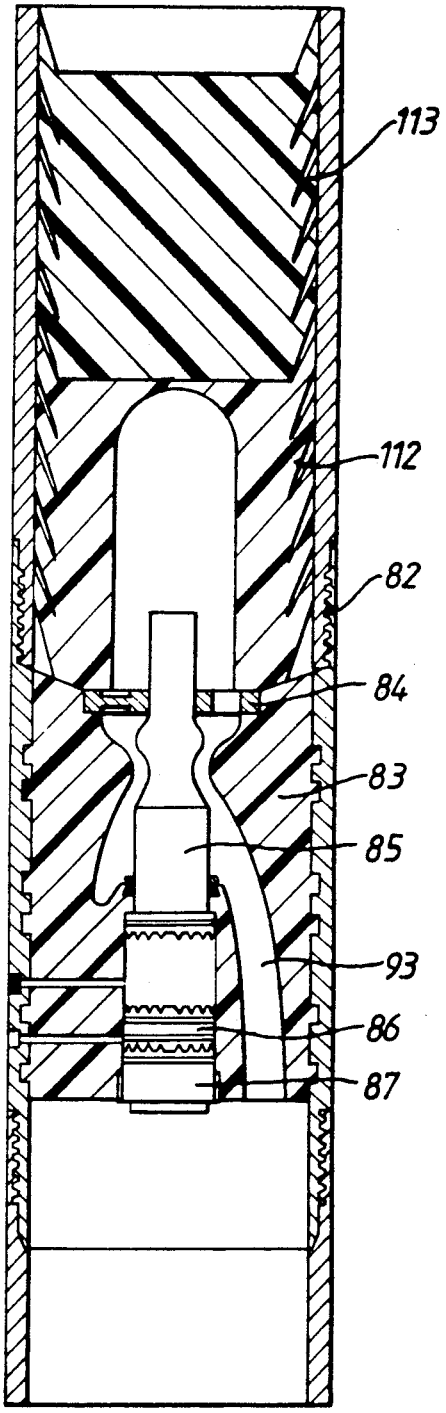
FIG. 17 is a similar view to FIG. 16 but showing the insertion of a top plug.

The casing may be plugged by the use of bottom and top plug 112 and 113 as shown in FIGS. 16 and 17. The bottom plug 112 engages in a frusto conical upper surface 114 of the body 83 which is provided with a rubber coating to ensure a seal.

It will be appreciated that the arrangement described above with reference to FIGS. 14 and 17 can be modified in a number of ways. The upper guide 84 could be formed integrally with the body 83. The flow control piston 85 and the upper passage section 90 could be formed differently in order to achieve the throttling effect on the cement slurry.

The lower passages 111 could be omitted if the cement slurry pressure is likely to remain constant.

It is customary to provide a one-way valve at the end of a casing string in an oil well in order to prevent fluids such as drilling mud and cement flowing back up the casing string. In the embodiments described above with reference to FIGS. 1 to 17, such a one-way valve will be provided in the casing string as an item separate from the device for controlling U-tubing. In the embodiment of the device shown in FIGS. 18 to 20, however, the one-way valve is incorporated in the device.

Figure 18:
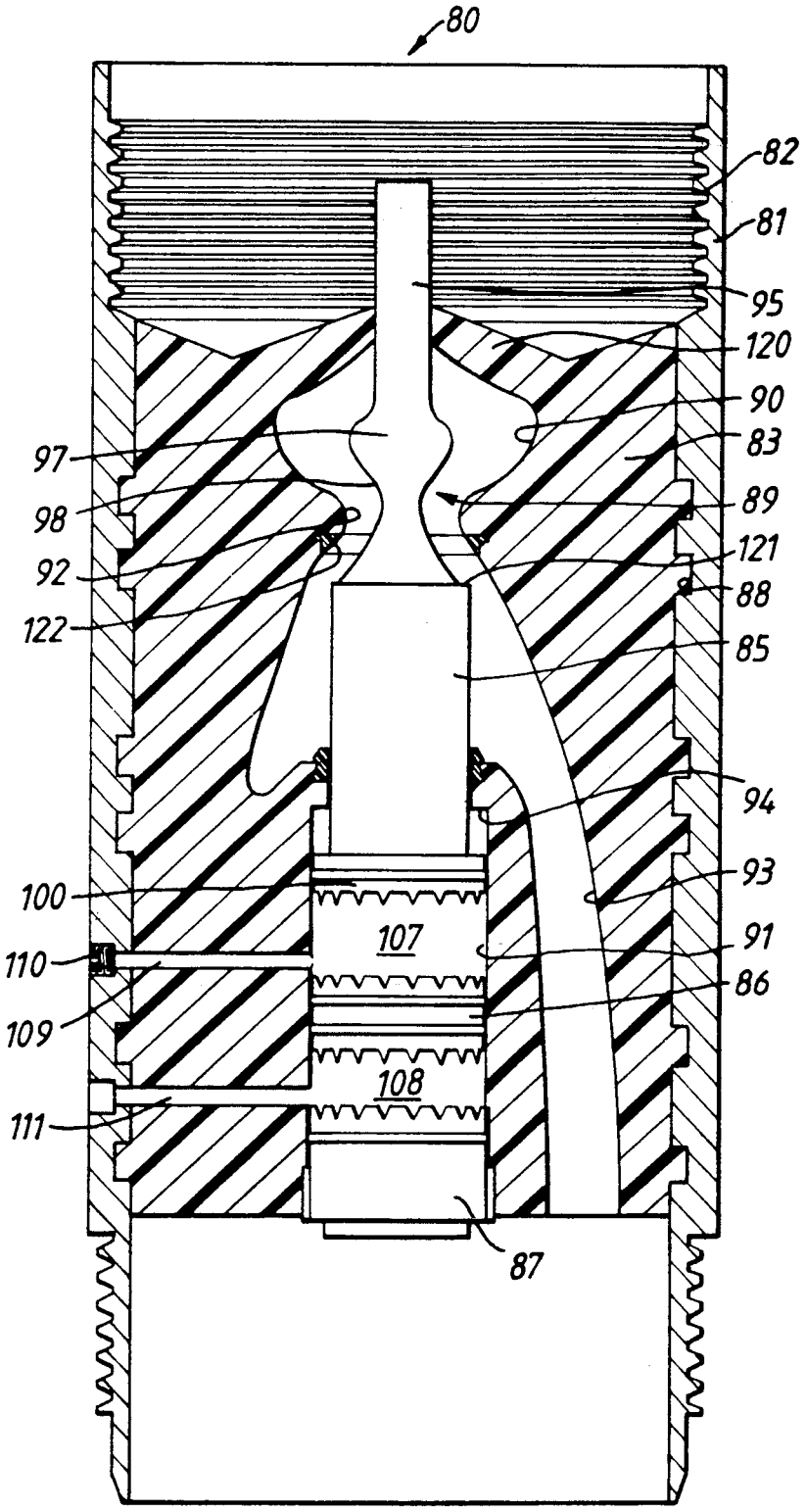
FIG. 18 is a similar view to FIG. 14 and showing a modified form of the third device providing a one-way valve as well as control of U-tubing.
Figure 19:
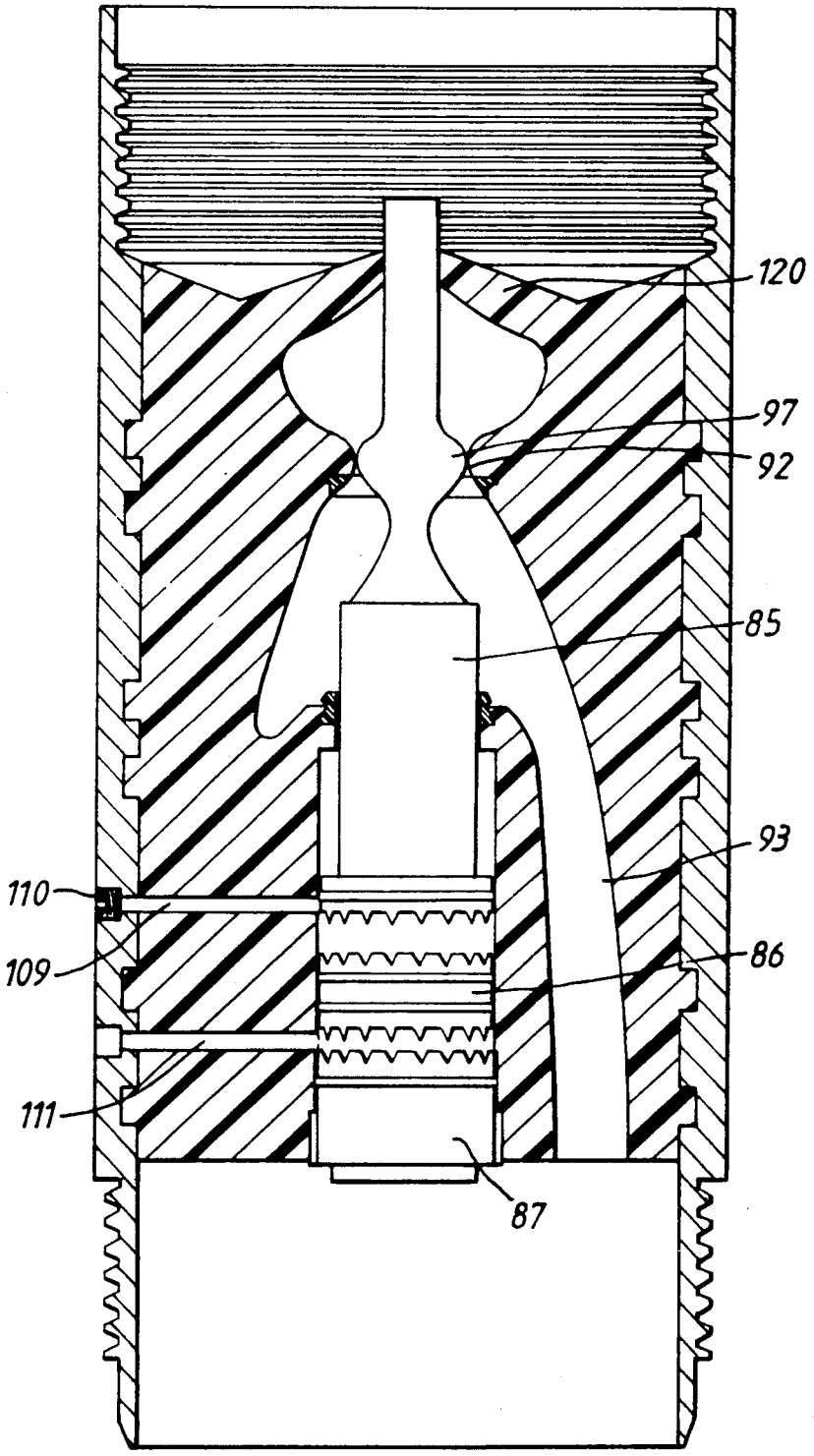
FIG. 19 is a similar view to FIG. 18 and showing the device of FIG. 18 in a position in which U-tubing is controlled.
Figure 20:
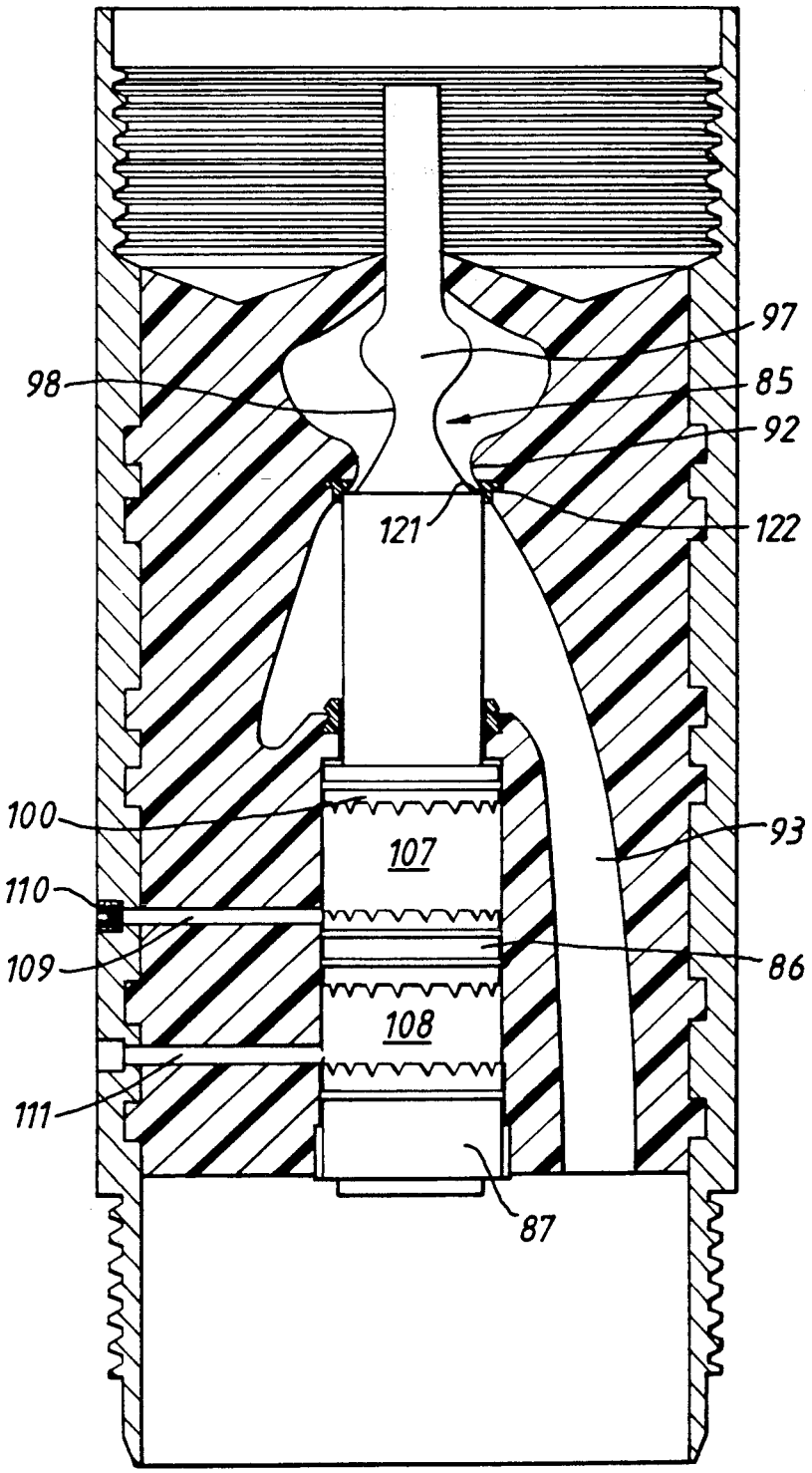
FIG. 20 is a similar view to FIGS. 18 and 19 but showing the device in a position in which it acts as a one-way valve.

The device of FIGS. 18 to 20 is similar to the device of FIGS. 14 to 17 and parts common to the two devices will be given the same reference numerals and will not be described in detail. In addition, the device of FIGS. 18 to 20 functions in generally the same way as the device of FIGS. 14 to 17 and so, where the function is the same, this will also not be described in detail.

The device of FIGS. 18 to 20 is provided with an upper guide 120 formed integrally with the body 83. The flow control piston 85 has the guide section 95 in contact with this upper guide 120 for guiding the flow control piston 85 in its sliding movement.

The flow control piston 85 is provided, below the wasted section 98, with an annular radially extending face 121 whose diameter is greater than the diameter of the throat 92. The body 83 is provided, beneath the throat, with an annular reinforced seat 122.

In addition, in the neutral position shown in FIG. 17, the head 100 of the flow control piston 85 is spaced from the step 94 to allow the possibility of both upward and downward movement of the piston 85.

The device of FIGS. 18 to 20 is installed as described above with reference to FIGS. 14 to 17. In the presence of U-tubing, it operates as described above with reference to FIGS. 14 to 17 so that, as seen in FIG. 19, the pressure of the cement moves the flow control piston 85 downwardly until the bulge 97 cooperates with the throat 92 to prevent U-tubing. When the pressure is removed, the flow control piston 85 moves upwardly to the position shown in FIG. 18, in order to allow flow once again.

The device operates as a one-way valve in the following manner.

Any tendency for cement or slurry to enter the open end of the casing string will be accompanied by an increase in pressure around the exterior of the casing so that the pressure below the device exceeds the pressure above the device. This will increase the pressure in the passages 111 and so increase the pressure acting on the lower surface of the middle piston 86. This in turn will increase the pressure in the upper chamber 107 and increase the pressure acting on the head 100 of the flow control piston 85. This will cause the flow control piston 85 to move upwardly until the face 121 on the flow control piston 85 engages the seat to close the passage 89 and so prevent the flow of fluid upwardly through the casing. This is shown in FIG. 20.

When the pressure around the exterior of the annulus decreases, the pressure on the lower surface of the middle piston 86 will decrease so allowing the flow control piston 85 to return to its neutral position shown in FIG. 18.

Although all the embodiments described above with reference to the drawings are for controlling 'U'-tubing in cement, it will be appreciated that they could be used to control 'U'-tubing in other fluids, such as drilling mud, that are passed through the casing string.

I claim:

1. A device for preventing 'U' tubing in the flow of fluid in oil well casings comprising a body for sealing engagement with an interior of a casing string towards an end thereof and having opposed end walls, a passage extending between said end walls for passing fluid under pressure from a supply thereof to the end of the casing, a member being arranged in said passage to move from a first position in which fluid flow through said passage is permitted and a second position in which said flow is reduced when the pressure in the flow of the fluid exceeds a predetermined value likely to cause the commencement of 'U' tubing, said member returning to said first position when said pressure reduces below the said predetermined value.

2. A device according to claim 1, wherein the member moves in accordance with a sensed pressure differential at spaced points in the flow of fluid and moves to said second position when said pressure differential exceeds a predetermined value.

3. A device according to claim 2, wherein the movement from said first to said second positions reduces said flow of the fluid, the member being movable to at least one further position to control said flow of fluid when the pressure differential exceeds at least one further predetermined value which is greater than the first mentioned predetermined value.

4. A device according to claim 2, wherein the member is a piston having opposed faces subject to the pressure of the fluid at respective said spaced points in the fluid flow, the piston moving in accordance with the differential between said pressures.

5. A device according to claim 4, wherein one face of the piston is subject to the pressure of the fluid at an inlet to said passage and the other face is subject to the pressure of the fluid at a point outside the casing level with the body.

6. A device according to claim 5, wherein the other face of the piston may be received within a chamber within the body, the chamber having an inlet extending through said body for communication with the outside of said casing, so that in use the chamber contains fluid at a pressure which is the pressure of the fluid outside the casing, said pressure acting on said other face of the piston member.

7. A device according to claim 1, wherein the member is subject to a biasing force maintaining said member in said first position until said pressure exceeds said predetermined pressure.

8. A device according to claim 7 wherein the member is carried on a support which provides said biasing force and deforms to allow said movement when said predetermined pressure is exceeded.

9. A device according to claim 8, wherein the support comprises a structural member which is fixed at one end and which is connected to the member at an end opposite said one end, said structural member deflecting to move said member to said second position when said first mentioned predetermined pressure is exceeded.

10. A device according to claim 9 wherein the movement from said first to said second positions reduces said flow of the fluid, the member being movable to at least one further position to control said flow of fluid when the pressure differential exceeds at least one further predetermined value which is greater than the first mentioned predetermined value and wherein at least one further structural member extends from said member and engage said body when the member is in said second position, said at least one further structural member deflecting to move said member to said at least one further position when said pressure differential exceeds the at least one further predetermined value.

11. A device according to claim 9 or claim 10, wherein the at least one structural member is removable to allow the use of members which deflect at different pressures.

12. A device according to claim 11, wherein the or each structural member is selected from the group of a strut and a ring.

13. A device according to claim 8, wherein the member is at least partially received in said passage, the member and the passage having complementary shaped portions that are in register in said first position to provide a path for the cement at maximum cross sectional area and are out of register in said second position to at least reduce said flow.

14. A device according to claim 10, wherein the member is at least partially received in said passage, the member and the passage having complementary shaped portions that are in register in said first position to provide a path for the cement at maximum cross sectional area and are out of register in said second position to at least reduce said flow and wherein the shaped portions, in said at least one further position, are arranged such as to provide a path for the cement of maximum cross sectional area, to provide a self-cleaning feature.

15. A device according to claim 10, wherein the member is at least partially received in said passage, the member and the passage having complementary shaped portions that are in register in said first position to provide a path for the cement at maximum cross sectional area and are out of register in said second position to at least reduce said flow and wherein at least two further positions are provided, the member, in the at least one further position before the last further position, decreasing the flow by successively greater amounts and, in said final further position, providing a path for the fluid at maximum cross-sectional area to provide a self-cleaning feature.

16. A device according to claim 1, wherein the body is formed by an outer shell and an inner core attached to the outer shell by releasable means which operate at pressures greater than the pressure which causes movement of the member to allow the core to separate from the outer shell and provide a path through the body for fluid of greater cross-sectional area than said passage.

17. A device according to claim 7, wherein the biasing force is provided by a volume of gas under pressure acting on the member in opposition to the pressure applied to the member by the fluid, the pressure being such that the member is maintained in said first position until said predetermined pressure is exceeded.

18. A device according to claim 17, wherein the body includes a floating piston, one surface of which is subject to the pressure of said gas and the other surface of which is subject to the pressure of the fluid outside the casing, so that the floating piston applies to the gas a pressure dependant on the pressure of the fluid downstream of the device, to compensate for variations in fluid pressure other than those likely to cause 'U' tubing.

19. A device according to claim 18 where the member comprises a piston having one end slidably received in a passage in the body to close one end of said passage, an opposite end of said passage being closed by said floating piston and the gas under pressure being held between the piston and the floating piston.

20. A device according to any one of claim 1 wherein the member is movable to a further position in which said flow is reduced when pressure of fluid downstream of the device exceeds the pressure of fluid upstream of the device, so acting as a one-way valve to prevent the flow of fluid up a casing string.

* * * * *